United States Patent [19]

Houston

[11] Patent Number: 4,898,015

[45] Date of Patent: Feb. 6, 1990

[54] PRESS BRAKE DEFLECTION COMPENSATING DEVICE

[76] Inventor: David L. Houston, P.O. Box 72757, Roselle, Ill. 60172

[21] Appl. No.: 220,505

[22] Filed: Jul. 18, 1988

[51] Int. Cl.[4] ..... B21D 5/02

[52] U.S. Cl. ..... 72/389; 72/446

[58] Field of Search ..... 72/389, 441, 446, 448

[56] References Cited

U.S. PATENT DOCUMENTS

| | | | |
|---|---|---|---|
| 2,199,864 | 5/1940 | Wehr | 72/448 |
| 2,456,856 | 12/1948 | Bath | 72/462 |
| 4,426,873 | 1/1984 | Pearson et al. | 72/389 |
| 4,449,389 | 5/1984 | Cros | 72/389 |
| 4,586,361 | 5/1986 | Reinhorn et al. | 72/389 |
| 4,736,612 | 4/1988 | Russell | 72/389 |

FOREIGN PATENT DOCUMENTS

| | | | |
|---|---|---|---|
| 0225818 | 12/1984 | Japan | 72/389 |

*Primary Examiner*—David Jones

*Attorney, Agent, or Firm*—Hill, Van Santen, Steadman & Simpson

[57] ABSTRACT

A deflection compensating device is provided for a press brake. The deflection compensating device includes a base member secured to the bed of the press brake. The base member supports two wedges thereon which extend the length of the device. A top member rests on the wedges, and the top member supports the die. The longitudinal ends of the top member, the base member, and the wedges are secured together. The wedges each have upper and lower angled sliding engagement surfaces engaging the top and base members. A screw device is provided to draw the middle of the wedges apart. This causes bowing of the wedges which cammingly bows the top member and the die to compensate for deflection during press operation. A symmetry support structure is provided to ensure that the wedges move equal distances from the center line when drawn apart. Guide pins extend through the top and base members to prevent transverse or twisting movement of the top and base members relative to each other.

9 Claims, 5 Drawing Sheets

PRESS BRAKE DEFLECTION COMPENSATING DEVICE

This invention relates to press brakes, and more particularly, to a device for overcoming the deformations of the press brake bed and ram which commonly occur even under normal loading and operation conditions.

The usual press brake has a stationary bed which supports a die and a movable ram on which the punch is rigidly affixed. In operation, the ram is moved downwardly, causing the punch to coact with the die to bend, shape, or otherwise form a work-piece placed between the punch and the die. Alternatively, the ram may be stationary, and the bed may be configured to move upwardly toward the ram.

The compressive forces applied to the work-piece by the ram and bed are quite high, generally exceeding several tons. As the bed and ram are typically supported only at two spaced positions along their respective longitudinal axes, placement of the die and tool set in the region between these respective support points results in the bed and ram deforming, or deflecting, during press brake operation. This, in turn, results in non-uniform and irregularly shaped finished products.

Various arrangements have been proposed to overcome press brake deflection. One such arrangement is the highly manual technique of simple shimming in which a plurality of shims, often of graduated thicknesses, are positioned between the die and bed. It will be appreciated that this approach is labor intensive—a limitation that is aggravated by the fact that no adjustment is possible. Should the degree of shimming not be properly selected the first time (and this is the normal situation as the precise magnitude of crowning is generally determined empirically), the entire shimming process must be repeated.

Several deflection compensating adjustment mechanisms have been proposed for incorporation in, or addition to, conventional press brakes. These include U.S. Pat. Nos. 4,347,727 to Galiger; 4,354,374 to Deguchi; 4,426,873 to Pearson; and, 4,586,361 to Reinhorn. As outlined hereinafter, these structures generally lack flexibility in use; are complex to operate and, therefore, expensive to purchase, install and maintain; and, finally, are structurally too high thereby severely limiting their utility as aftermarket add-ons.

In this latter regard, it should be noted that each press brake defines a maximum vertical opening or reach between its ram and bed. The installation of a deflection compensating mechanism on top of the press brake bed, therefore, consumes a significant portion of this available vertical space otherwise dedicated to die and tool placement and for work-piece manipulation and clearance.

With specific reference to the above cited patents, Galiger '727 employs a fairly bulky and complex arrangement of multiple individual wedges, each of which is acted upon by an adjustable beam/bolt member. This beam member is, in turn, driven by a hydraulic linear actuator. As will become clearer below, Galiger '727 does not employ the two-sided or dual-opposed wedge structure of the present invention and, therefore, Galiger does not exhibit the corresponding size, safety and symmetrical deflection compensating force application features of this invention.

Deguchi '374 similarly uses a plurality of individual single-sided wedge pairs spaced longitudinally along the press brake bed to effect anti-crowning adjustment. Individual rack and pinion adjustments are provided for each wedge pair. Indeed, proper alignment of Deguchi requires adjustment of each such wedge pair.

Nor does Deguchi provide a unitary substructure suitable for aftermarket addition to existing press brakes. The existing press brake bed becomes an integral member of the Deguchi adjustment mechanism, requiring placement of the pinion and rack adjustment members within the bed, itself. This represents a substantial and often unacceptable modification to the bed of a conventional press brake.

Pearson '873 and Reinhorn '361 each employ a single one-sided wedge pair to effect deflection compensation. More specifically, these systems use a non-uniform wedge of graduated cross-section and irregularly spaced cut-outs to achieve the desired deflection compensation. Neither Pearson nor Reinhorn incorporate the present two-sided or dual-opposed wedge structure. As a consequence, these systems require a higher and substantially more rigid wedge retainment substructure to laterally restrain the wedges against the asymmetrical forces generated thereby.

The present invention relates to a press brake deflection compensation system suitable for incorporation as an integral part of the press brake at the time of manufacture or as a field-installable aftermarket addition to an existing press brake.

In this latter capacity the present invention incorporates a novel twin-faced, dual wedge arrangement which provides excellent deflection compensation in a structure of generally low complexity and, importantly, of minimum vertical profile. More specifically, the present system employs a pair of substantially identical wedges positioned in opposed relationship between mating dual-sloped base and top members.

This symmetrical construction exhibits several beneficial features not found in the prior art including the fact that the respective wedge actuation forces are equal, opposite and, further, directed laterally outwardly. In this manner, the force required to properly position one wedge may be supplied by the corresponding actuation force of the second wedge. Thus, a substantially less rigid and bulky actuation mechanism can be employed by reason that the real forces of actuation are, in essence, acting against one-another in cancellation.

By contrast, the force of actuation in single wedge structures, for example Pearson '873, must be generated in full and by creating a mechanically secure surface against which the opposite, but equal, counterforce can work.

Another significant feature of the present dual wedge arrangement is its inherent 'inward seeking' force structure. As previously noted, under normal press brake loading conditions, the downward force on the die, and in turn the deflection compensation, may reach the multi-ton magnitude. This downward force, acting upon the wedges, generates a substantial transverse, lateral force on each wedge, the effect of which is to urge the wedges outwardly apart. It will be seen, therefore, that the prior art single wedge structures necessarily require rigid side-rail members to prohibit such outward wedge egress. Pearson '873 and Reinhorn '361 are illustrative of prior art structures utilizing wedge-retaining sidewall members.

The present deflection compensation device by comparison employs a bed member and a top member, each of which incorporates dual, oppositely sloped wedge engagement surfaces. The downward press brake force, acting upon the present deflection compensation device, creates equal but opposite lateral forces on the opposed surfaces of the respective bed and top members. In this manner, the sum force acting on each member is zero. There is, consequently, no requirement to provide for other than nominal bed and top member positioning.

It will be further appreciated that the wedges of the present invention are, themselves, urged inwardly toward each other. They are 'inward seeking'. Again, no wedge restraint structure is required.

In addition to the structural advantages just discussed, the inward seeking character of the present invention offers a high level of operator safety. There is no possibility, as there would be with the prior art systems, that a wedge might inadvertently be 'shot' from the deflection compensation device.

The present invention advantageously employs twin-faced wedge members. This arrangement facilitates a greater vertical deflection compensating extension in a structure which is overall of the lowest possible profile. As noted, a low profile is highly desirable in a device suitable for aftermarket installation on existing press brakes. The twin-faced wedge permits use of smaller wedge angles (i.e. more acute) for any given vertical rise and wedge lateral displacement. This, in turn, lowers the lateral forces generated by and acting upon the wedges thereby correspondingly lessening the rigidity requirements of the actuation mechanism. It will also be noted that the lower the wedge angle, the less likely are misadjustments occasioned by lateral wedge slippage.

As previously described, the present dual-wedge arrangement advantageously facilitates the use of mechanically straight-forward and relatively light-duty deflection adjustment mechanisms. One such preferred adjustment mechanism is a lead-screw, single or multiple. Each lead-screw is threaded through one wedge into engagement with the other. As the lead-screw is advanced inwardly, it acts against, and urges, the second wedge outwardly away therefrom.

The present adjusting mechanism further includes a symmetry support structure. It will be appreciated that the proposed lead-screw adjustment mechanism merely adjusts the relative inward and outward lateral movement of the respective wedges. In order to assure proper tool alignment, it is important that the top member of the deflection compensating device be urged uniformly upwardly with respect to the bed and deflection compensation device base member.

Slight irregularities between the respective wedges and base and top members could, in the absence of the present symmetry support structure, result in a greater lateral movement of one wedge as compared to the other. Such unequal wedge movement would likely result in the device top member, with die mounted thereon, being offset laterally and rotated about the longitudinal axis.

The present symmetry support structure includes a vertical pin rigidly affixed to the base member. The pin is slidably received by the top member to assure proper lateral alignment thereof. To assure proper co-movement of the wedges, however, a lever is rotably mounted on the pin. Longitudinal slots are formed in the opposed ends of the lever which slots serve to engage additional pins, one rigidly affixed to each wedge. In this manner, the movement of one wedge is reflected through the center-pivoted lever thereby forcing equal lateral movement of the second wedge.

Other features, purposes and objects of the invention will become apparent from the following specification.

DESCRIPTION OF THE PREFERRED EMBODIMENT

Figure 1:
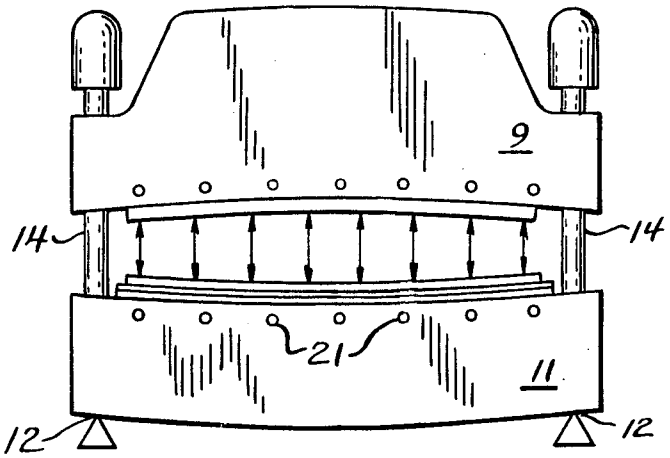
FIG. 1 shows an elevational view of a press brake, showing greatly exaggerated deflection of the bed and ram during operation.

FIG. 1 illustrates, in exaggerated form, the deformation or deflection of a conventional press brake bed 9 and ram 11 under ordinary loading conditions. As is well known, during normal press brake operation, the ram and bed or, more accurately, the tool 13 and die 31 (FIG. 2) positioned respectively thereon, are driven into engagement under great force, usually several tons per foot of press brake length.

Conventionally, the bed of the press brake is supported only at its ends 12. Similarly, the ram is driven downwardly at two generally opposed end points 14. Notwithstanding that the bed and ram are typically of massive size, placement of the tool and die set along the center region of the press brake, as is customary and proper, results in the deformation or bowing of both the bed and ram. Although this deformation or deflection is of relatively small dimension, usually less than 0.1 inches, it remains sufficient to introduce undesirable inaccuracy into otherwise high-tolerance bending jobs.

The present deflection compensation apparatus is preferably positioned on the bed of the press brake. It will be appreciated, however, that a substantially identical apparatus could be affixed to the ram in addition to or in lieu of the bed-mounted unit. Where a single bed or ram-mounted deflection compensation apparatus is employed, it is contemplated that such unit shall be adjusted to compensate for the combined deformation of both bed and ram.

Figure 2:
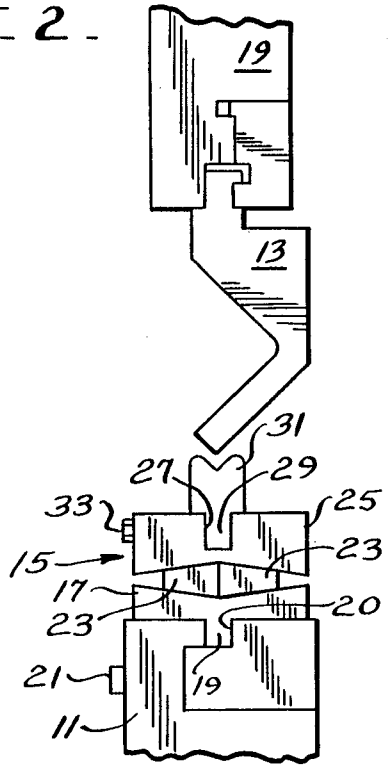
FIG. 2 shows an end view of a press brake having the crowing device of this invention.

FIG. 2 shows an end view of a press brake equipped with the deflection compensation device of this invention. The ram 9 supports a punch 13 secured thereto by any of a variety of clamp structures well known in the art. As noted, the bed 11 preferably supports the crowning device shown generally at 15.

The deflection compensation device 15 includes a base or lower body member 17 which has a downwardly extending ridge 19 along its full longitudinal length. Ridge 19 is adapted for receipt in a corresponding recess 20 provided within the upper surface of conventional press brake beds. The deflection compensation device may be affixed to the bed by any of a variety of well-known clamp methods, such as bolt 21, or it may simply be retained by gravity and the intersection of ridge 19 with slot 20.

It will be appreciated from the foregoing that the present deflection compensation device is preferably designed to emulate a die in its connection to the bed and therefore may be applied as an aftermarket accessory to virtually any press brake which accepts standard dies.

Figures 3, 4, 5:
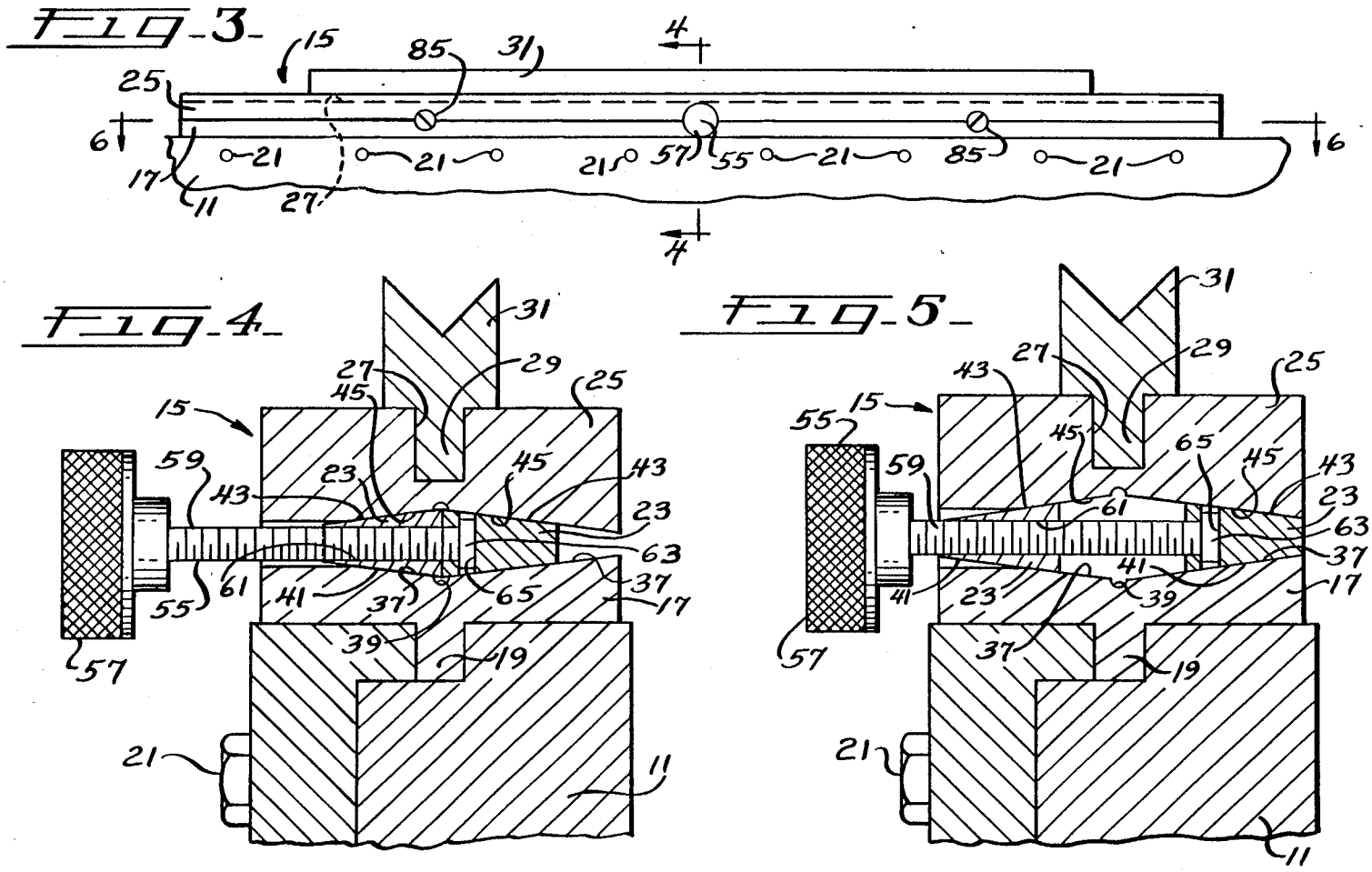
FIG. 3 is an elevational view of the bed of the press brake having the crowing device of the invention.
FIG. 4 is a section view taken along line 4—4 of FIG. 3 and showing the wedges in the flat or non-crown position.
FIG. 5 is a view as in FIG. 4, but showing the wedges drawn apart into a crown position.

As best shown in FIGS. 4 and 5, the upper surface of base member 17 forms a generally V-shaped contour comprising a pair of opposed planar wedge-engaging surfaces 37. Surfaces 37 are symmetrically disposed about a vertical plane defined along the center of force of the press brake bed and ram. Surfaces 37 form the first or lower camming surface for each of the twin-faced wedges 23 discussed below.

In a substantially identical manner, the downwardly facing surface of the top member 25 forms an inverted V-shaped contour comprising a pair of opposed planar surfaces 45. Surfaces 45 form the second or upper camming surface for each of the respective wedges 23.

Figure 6:
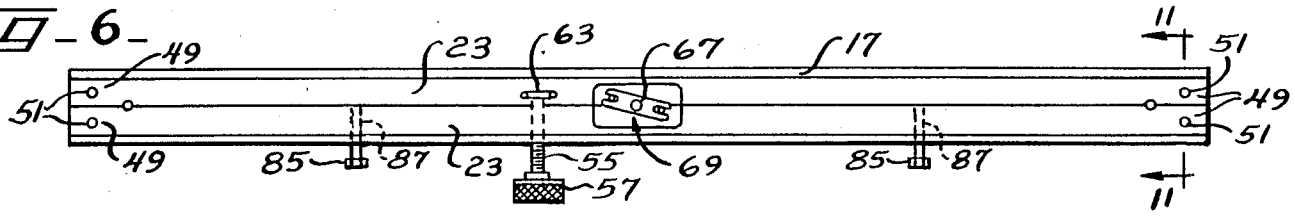
FIG. 6 is a view taken along line 6—6 of FIG. 3, showing the wedges in the non-crown position.
Figure 7:
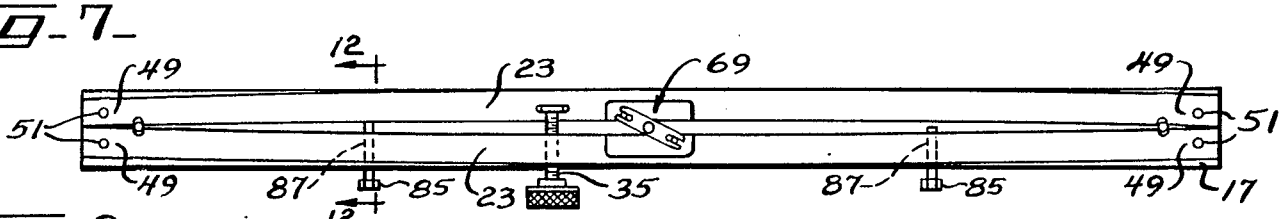
FIG. 7 is a view as in FIG. 6, but showing the wedges bowed apart in a crown position.
Figure 11:
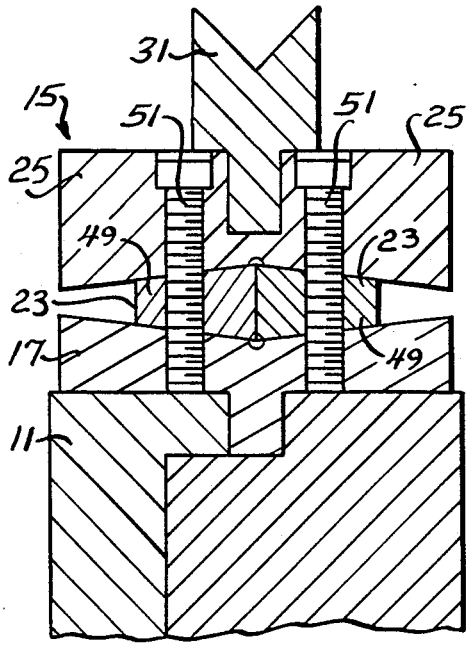
FIG. 11 is a section view taken along line 11—11 of FIG. 6 to show the securement of the ends of the wedges in the compensation device.
Figure 12:
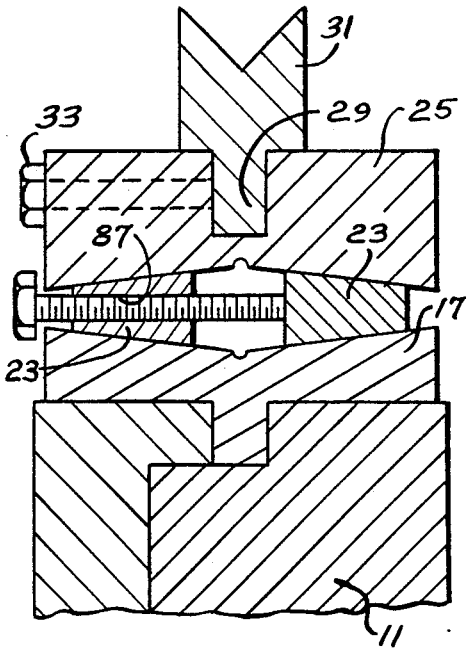
FIG. 12 is a section view taken along line 12—12 of FIG. 7, and showing the mechanism for fine tuning the curvature of the wedges.

Referring to FIGS. 2, 6 and 7, a pair of wedges 23 are shown in opposed side-by-side relationship between base and top members 17 and 25. Wedges 17 extend longitudinally along substantially the entire length of the base and top members and are secured to these members by bolts 51 (FIG. 11). Bolts 51 function additionally as the means for securing the entire deflection compensation device together as an integral unit. In this manner, the adjacent longitudinal ends of the wedges and base and top members are held in proper alignment. Alignment of the deflection compensation device between these end regions is assured, first, by reason of the inherent rigidity of the base and top members and, second, by use of a medial guide pin 67 described in further detail below.

Figure 13:
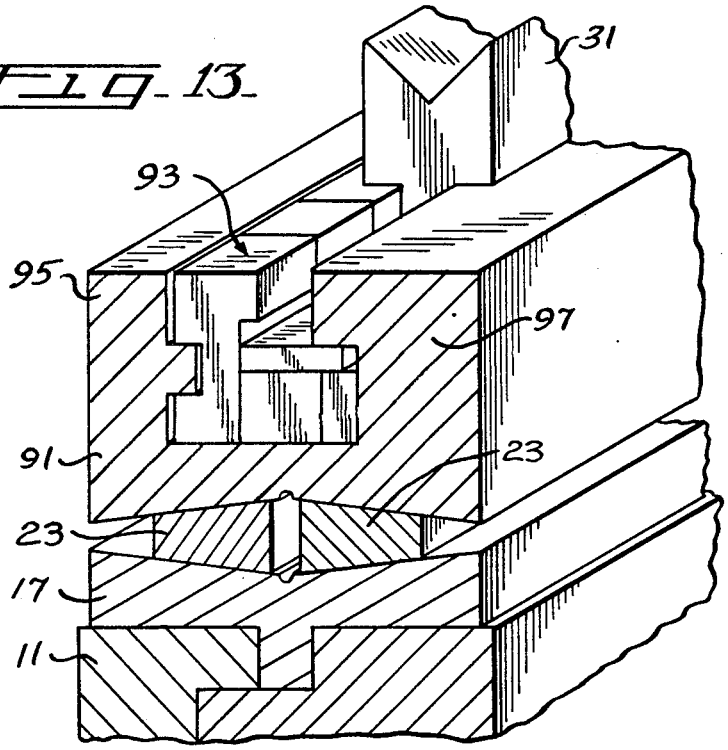
FIG. 13 is a perspective view of an alternate embodiment wherein the top member of the deflection compensation device includes an alternate type of clamping device enclosed within the body of the top member; and, FIG. 14 is an end view of an alternate embodiment of the deflection compensation device of this invention.

As best illustrated in FIGS. 2 and 13, wedges 23 are of uniform, trapezoidal cross-section. Wedges 23 each include lower and upper camming or wedging surfaces 41 and 43, respectively. These surfaces are planar and are adapted to slidably engage corresponding base and top member surfaces 39 and 45.

For proper wedging action, the angle of each lower wedge surface 41 must be substantially the same as the angle of the corresponding base member surface 37 (these angles being conveniently defined relative to a horizontal plane) and, similarly, the angle of each upper wedge surface 43 must be the same as that of the corresponding top member surface 45. The upper and lower wedging angles will generally be the same, preferably about 7.5 degrees, although it will be understood that a range of angles may be used to accomplish similar results.

Use of the present twin-faced wedge 23, i.e. one having both lower and upper wedging surfaces, advantageously permits use of lower wedging angles which, in turn, reduces actuation friction and the possibility of unexpected wedge slippage. For example, the present dual 7.5 degree wedge requires approximately 0.38 inches of lateral wedge movement to generate a tenth inch of adjustment. A single-sided wedge arrangement, such as taught by the prior art, would provide only about one-half as much adjustment for the same lateral wedge displacement. Alternatively, the same compensation can be achieved, but only by increasing the wedging angle to nearly 15 degrees. As is well known, for any given coefficient of friction, increasing the wedging angle correspondingly increases the probability of wedge slippage.

FIGS. 4 through 7 illustrate the basic camming action of the wedges 23. When little or no adjustment is desired the wedges are moved together, as in FIGS. 4 and 6. In this position, the cross-section of the deflection compensation device remains substantially the same along its full longitudinal length which, in turn, results in the correspondingly uniform displacement of the top member 25 (above the press brake bed) along its length. Thus, no deflection compensation occurs.

As the center region of the wedges is moved laterally outwardly, the magnitude of the deflection compensation is correspondingly increased. This is best shown in FIGS. 5 and 7.

It will be appreciated that the longitudinal end regions 49 of the wedges remain in substantially abutting contact by reason of bolts 51 which secure the wedges in fixed relationship to the base and top members. The wedges, however, are not restrained in the center region and are therefore free to travel outwardly into the position shown in FIGS. 5 and 7.

In this position, the camming action of the wedges forces the top member upwardly (FIG. 5) as compared with the corresponding position of the top member in the end region which, as noted, remains as shown in FIG. 4. In this manner, the center region of the deflection compensation device is forced upwardly thereby creating the required compensation.

Figure 8:
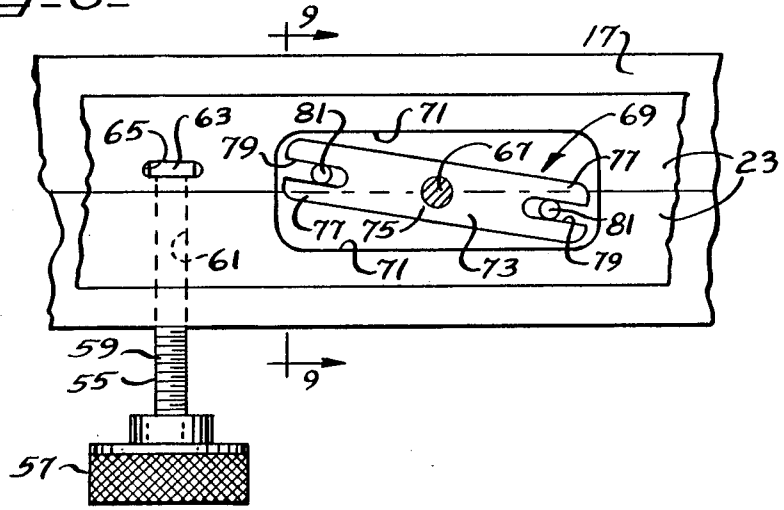
FIG. 8 is an enlarged view of the structure for drawing the wedges apart and the symmetry support in the non-crown position.

FIGS. 4, 5 and 8 illustrate the actuating or adjusting mechanism of the present invention. The wedges are urged laterally apart, or together, by means of a screw structure 55. Screw structure 55 includes a handle 57 and a threaded portion 59 attached thereto. The threaded portion 59 is threaded into a laterally extending passage 61 in one of the wedges 23. The threaded portion 59 has an engagement portion 63 which is entrapped within cavity or recess 65 in the other of the wedges 23. When the handle 57 is rotated, this causes the wedges 23 to move together or apart depending on the direction of rotation. The camming action of the wedges 23 causes the top member 25 to curve upwardly, or crown, between its longitudinal ends, compensating for the bowing of the bed and ram.

To ensure that the top member 25 moves substantially linearly vertically, without undesirable twisting or lateral movement, guide means for guiding the top member in linear movement are provided. The guide means includes a base/top alignment structure to preclude the relative lateral movement of the top and base members 17 and 25 and a symmetry support structure to force the equal lateral movement of the wedges 23.

Figure 9:
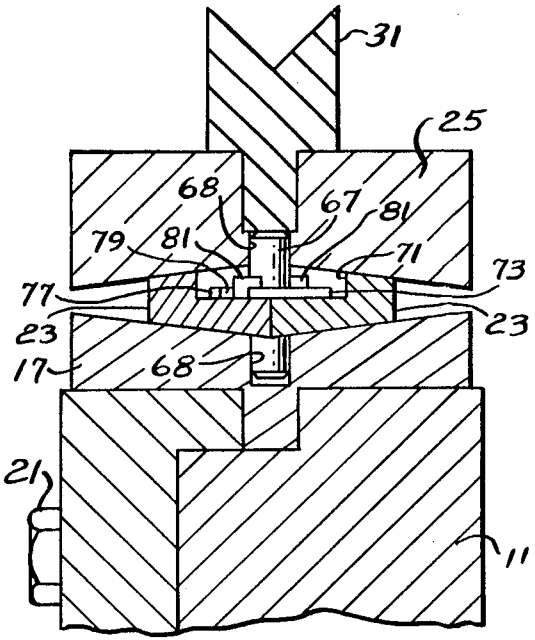
FIG. 9 is a sectional view taken along line 9—9 of FIG. 8.

Referring to FIGS. 8 and 9, the base/top alignment structure includes a vertical guide pin 67 extending between the base and top members, generally in the centers thereof. Pin 67 is retained within vertical passages or openings 68 of the base and top members. In this manner, the base and top members may freely move with respect to one-another in the vertical direction, i.e. along the axis of pin 67, but are restrained from moving in the sheer or lateral direction.

The center guide pin 67 is also part of the symmetry support structure generally indicated at 69 (FIGS. 7 and 8). The symmetry support structure 69 is provided to ensure equal lateral displacement of the opposed wedges 23 from the longitudinal center line of the deflection compensation device 15. This aids in supporting the die 31 in proper orientation below the complementary tool 13, that is, without any rotational or lateral deviation.

Figure 10:
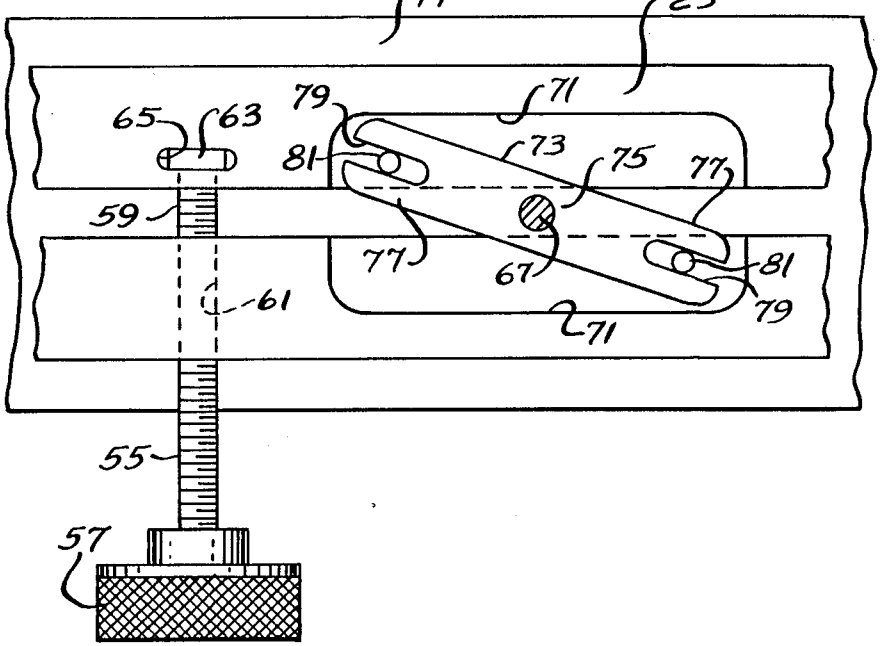
FIG. 10 is a view as in FIG. 8, but showing the wedges in a crown position.

The symmetry support structure, as shown in FIGS. 9 and 10, is housed in adjacent recesses or cavities 71 formed in each of the wedges 23. The symmetry support structure includes a lever 73 having a middle portion 75 pivotally supported on pin 67, and opposed end portions 77. Each end portion has a slot 79 therein which receives a pin 81 rigidly secured to a respective wedge 23.

Pins 81 are spaced equidistant from guide pin 67. This equidistant relationship does not vary as a function of the angular orientation of lever 73 nor with the corresponding changing wedge 23 spacing. Consequently, as the relative spacing between the wedges 23 is altered, lever 73 geometrically forces pins 81 to be positioned equally from the longitudinal center axis which, in turn, assures the symmetric lateral movement of the wedges with respect to the base and top members.

Figure 14:
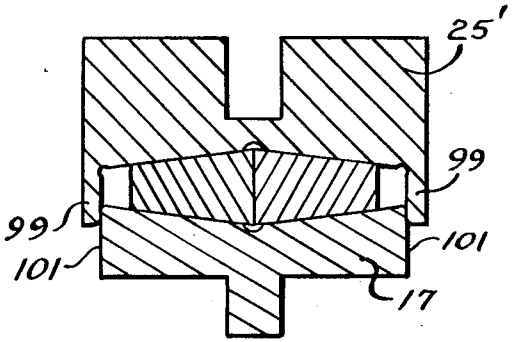

An alternative guide means may be employed as shown in FIG. 14. The guide means of FIG. 14 includes a pair of spaced flanges or walls 99 integrally formed, and depending downwardly from, the top member 25'. Walls 99 preferably extend along the full longitudinal length of the top member 25' and protrude downwardly sufficiently to overlap and abut the sides 101 of the base member 17. In this manner, lateral relative movement of the base and top members is precluded. Guide walls 99 may be used independently or in combination with the symmetry support structure described above.

For certain applications, it may be desirable to provide a deflection compensation contour somewhat different from that which would normally result from the single screw structure 55 discussed above. To accomplish this, a multiple or fine adjustment structures, for example bolts 85, may be provided at spaced intervals along the deflection compensation device longitudinal axis. (see FIGS. 3, 6, 7 and 12). These additional adjustment mechanisms may be of the captured variety, such as discussed with respect to screw structure 55 above, or they may be of the simple contact variety, having only the more limited capability of urging the wedges laterally apart.

FIG. 13 shows an alternate embodiment wherein a similar double wedge device is provided with a top member 91 which includes a clamping system generally indicated at 93 supported in a recess defined by upwardly extending side portions 95 and 97. Such a clamping system is disclosed in co-pending U.S. patent application, Ser. No. 201,541, filed June 2, 1988.

The foregoing specification describes the preferred and best embodiment of the invention as presently contemplated. The language used herein should be read as descriptive and not limiting, as those familiar with the art and with this specification before them will be able to make modification therein without departing from the scope of the invention as claimed.

What is claimed:

1. In a press brake having a bed for supporting a tool and a ram for supporting a mating tool, press brake bed and ram deformation compensation apparatus for placement between one of said tools and the press brake bed and ram, the compensation apparatus including an elongate base member, an elongate top member and a pair of elongate wedge members; the base and top members each having adjacent first and second planar surfaces which intersect to form a V-shaped longitudinal recess thereon, the respective V-shaped surfaces being oriented in opposed facing relationship; the wedge members each having upper and lower planar surfaces; the wedge members being oriented between the opposed V-shaped base and top member surfaces whereby the upper and lower planar surfaces of one wedge member slidably engage, respectively, the first surfaces of the V-shaped recesses in the base and top members and the upper and lower planar surfaces of the other wedge member slidably engage, respectively, the second surfaces of the V-shaped recesses in the base and top members; means for securing the wedge members to the base and top members at the opposed longitudinal ends thereof; means for applying lateral forces to the wedge members between the longitudinal ends thereof whereby the longitudinal center regions of the wedge members may be selectively spaced apart a predetermined distance thereby producing an deflection compensating deformation of the top member.

2. The press brake deflection compensation apparatus of claim 1 including means for symmetrically controlling the lateral spacing of the wedge members whereby the wedge members are spaced equally and symmetrically in relation to a center axis of the deflection compensation apparatus for any selected predetermined spacing distance.

3. The press brake deflection compensation apparatus of claim 2 wherein the means for symmetrically controlling the lateral spacing of the wedge members includes a pin affixed to one of the base and top members substantially along the center axis; a lever mounted at the center thereof for pivotal movement on the pin; means on each of the opposed ends of the lever for engaging the wedge members whereby the lever equally and symmetrically spaces the wedge members in relation to the center axis mounted pin.

4. The press brake deflection compensation apparatus of claim 1 including alignment guide means whereby the top member is constrained against relative rotational and lateral movement with respect to the base member for any degree of press brake deflection compensation.

5. The press brake deflection compensation apparatus of claim 4 wherein the alignment guide means includes means for limiting the relative lateral movement between the base and top members and symmetry control means for positioning the wedge members equally from a deflection compensation apparatus center axis.

6. The press brake deflection compensation apparatus of claim 5 wherein the means for limiting the relative lateral movement between the base and top members is a pin affixed to one of the base and top members and extended into sliding engagement with the other of the base and top members; and the symmetry control means includes a lever mounted at the center thereof for pivotal movement on the pin.

7. The press brake deflection compensation apparatus of claim 1 including guide means for limiting the relative lateral displacement of the top and bottom members.

8. The press brake deflection compensation apparatus of claim 7 wherein the guide means for limiting the relative lateral displacement of the top and bottom members includes first and second wall members extending from one of the top and bottom members and overlaping the opposed sides of the other of the top and bottom members whereby said walls of the one member interferingly engage the sides of the other member thereby precluding the lateral relative displacement therebetween.

9. In a press brake having a bed for supporting a tool and a ram for supporting a mating too, press brake bed and ram deflection compensation apparatus for placement between one of said tools and the press brake bed and ram, the compensation apparatus including an elongate base member, an elongate top member and a pair of elongate wedge members; one of the base and top members having adjacent first and second planar surfaces which intersect to form a V-shaped longitudinal recess thereon, the other of the base and top members having a substantially flat planar surface; the respective V-shaped and flat surfaces being oriented in opposed facing relationship; the wedge members each having a pair of opposed non-parallel planar surfaces; the wedge members being oriented between the base and top members whereby one surface of each wedge member slidably engages respective first and second planar surfaces of the V-shaped recess of the one base and top member and the other surface of each wedge member slidably engages the opposed flat surface of the other base and top member; means for securing the wedge members to the base and top members at the opposed longitudinal ends thereof such that the ends of the wedge members are retained in a fixed predetermined position against lateral movement with respect to the base and top members; means for applying lateral forces to the wedge members between the longitudinal ends thereof whereby the longitudinal center regions of the wedge members may be selectively spaced apart a predetermined distance thereby producing an anti-crowning compensation deflection of the top member.

* * * * *